United States Patent [19]

Pollak

[11] 4,355,950

[45] Oct. 26, 1982

[54] SELF-PRIMING CENTRIFUGAL PUMP

[76] Inventor: Henry M. Pollak, 823 Brookside Rd., Pottstown, Pa. 19464

[21] Appl. No.: 153,500

[22] Filed: May 27, 1980

[51] Int. Cl.[3] ..... F04D 9/02

[52] U.S. Cl. ..... 415/53 R

[58] Field of Search ..... 415/11, 53 R, 52

[56] References Cited

U.S. PATENT DOCUMENTS

| | | | |
|---|---|---|---|
| 2,428,487 | 10/1947 | Fernstrum | 415/53 R |
| 2,477,079 | 7/1949 | Mueller | 415/53 R |
| 2,944,489 | 7/1960 | Longenecker | 415/53 |
| 2,956,505 | 10/1960 | Jekat et al. | 415/53 |
| 3,685,919 | 8/1972 | Speck et al. | 415/53 R |
| 4,057,361 | 11/1977 | Renaud | 415/53 R |
| 4,129,402 | 12/1978 | Eberhardt | 415/53 R |

*Primary Examiner*—Louis J. Casaregola

*Attorney, Agent, or Firm*—Seidel, Gonda, Goldhammer & Panitch

[57] ABSTRACT

A centrifugal pump having a discharge at its upper end is self-primed under the combined effect of gravity and suction. The suction is created by a discontinuity of flow in the pumping chamber at a recirculation passage. The passage is sufficiently large so that it deaerates priming liquid while providing sufficient liquid to prevent a short circuit of gas from the outlet to the inlet.

7 Claims, 8 Drawing Figures

3

FIG. 5
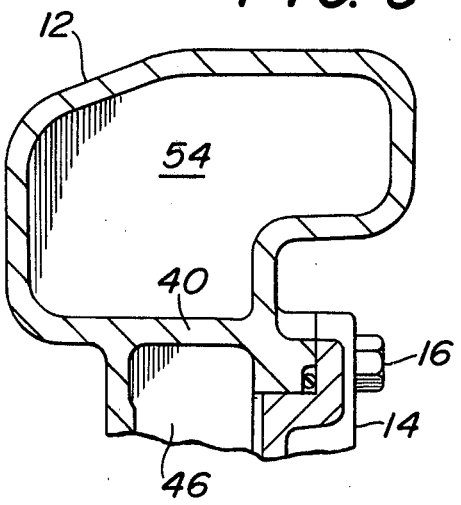
FIG. 6
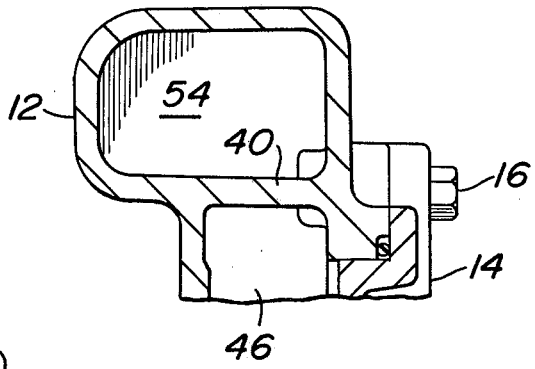
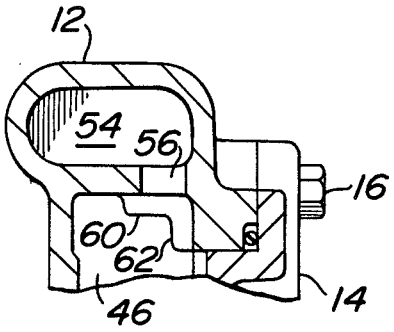
FIG. 7
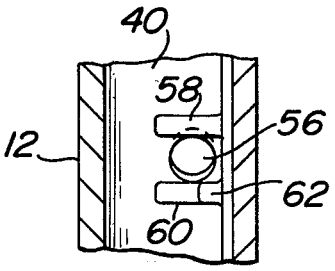
FIG. 8

SELF-PRIMING CENTRIFUGAL PUMP

BACKGROUND

Self-priming centrifugal pumps are per se old and well known. A self-priming centrifugal pump will, with an initial charge of water or other liquid, evacuate the suction lines so that it can begin pumping without an outside priming aid. Generally the discharge line is left open to the atmosphere during the priming cycle or similar provision is made so that the air or gas evacuated from the suction line can escape.

Most self-priming centrifugal pumps are configured in a manner so as to provide several necessary elements. A first element involves sealing of passages from suction to discharge so that evacuated gas is not short circuited from discharge back to suction during the priming cycle. A second element involves recirculation of liquid as the initial charge in the casing. The basic mechanism of self-priming involves mixing the recirculating liquid with air or gas from the suction, then deaerate the liquid, and then return the liquid for use in picking up more air or gas.

In connection with the above requirements of self-priming, the following facts establish the variables in self-priming ability and speed of self-priming, both of which become criteria in the appraisal of the self-priming ability of the pump. First, the quantity of liquid that is contained in the casing during the priming cycle will effect the priming ability. The more liquid that is contained in the casing, the less necessary that liquid be quickly deaerated. Recirculation of deaerated liquid can be accomplished simply by having large quantities of liquid in the casing and recirculating the liquid from a point in the casing where it is least likely to contain maximum amounts of air. Secondly, the driving mechanism that recirculates the liquid must be sized and designed in such a way that it does not recirculate the liquid that has not yet been deaerated. Third, the general shape and size of the recirculating passage affects the efficiency of the deaeration.

The present invention addresses itself to solving the problem of improving self-priming of a centrifugal pump whereby less priming liquid is needed.

SUMMARY OF THE INVENTION

The present invention is directed to a self-priming centrifugal pump wherein a casing has an inlet and an outlet. A motor driven impeller is provided within a pumping chamber in the casing for pumping liquid from the inlet to the outlet. A wall of the casing has a flow passage for recirculating a liquid from the outlet to the pumping chamber at a location radially outwardly from the impeller. A discontinuity of flow is created in the pumping chamber at said passage so that liquid can be recirculated under the combined forces of gravity and suction to self-prime the pump. The passage is sufficiently large so that it deaerates the priming liquid while supplying sufficient liquid to prevent a short circuit of gas from the outlet to the inlet.

It is an object of the present invention to provide a self-priming centrifugal pump requiring less priming liquid.

It is another object of the present invention to provide a centrifugal pump with means for self-priming which is simple, inexpensive and reliable for minimizing the amount of liquid needed for self-priming.

Other objects will appear hereinafter.

For the purpose of illustrating the invention, there is shown in the drawings a form which is presently preferred; it being understood, however, that this invention is not limited to the precise arrangements and instrumentalities shown.

FIG. 5 is a sectional view taken along the line 5—5 in FIG. 3.

FIG. 6 is a sectional view taken along the line 6—6 in FIG. 3.

FIG. 7 is a sectional view taken along the line 7—7 in FIG. 3.

FIG. 8 is a view taken along the line 8—8 in FIG. 3.

DETAILED DESCRIPTION

Figure 1:
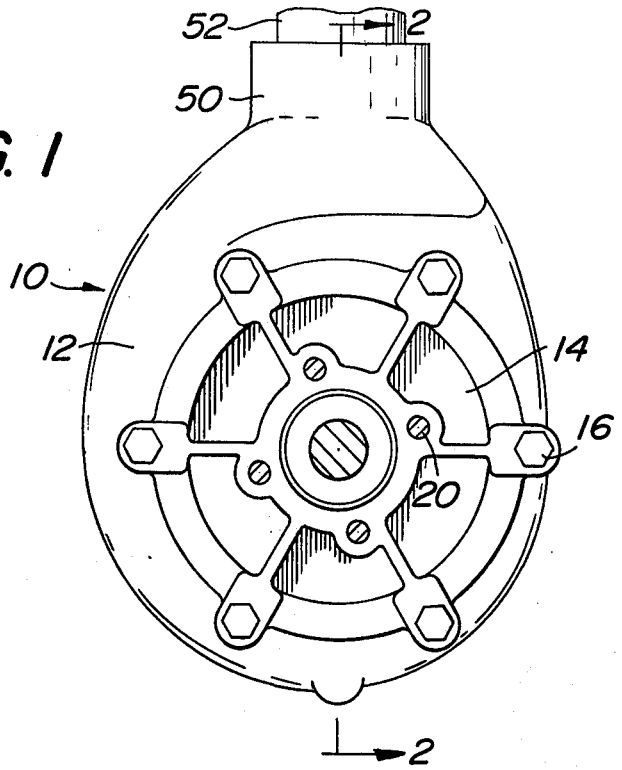
FIG. 1 is a side elevation view of a centrifugal pump in accordance with the present invention.
Figure 4:
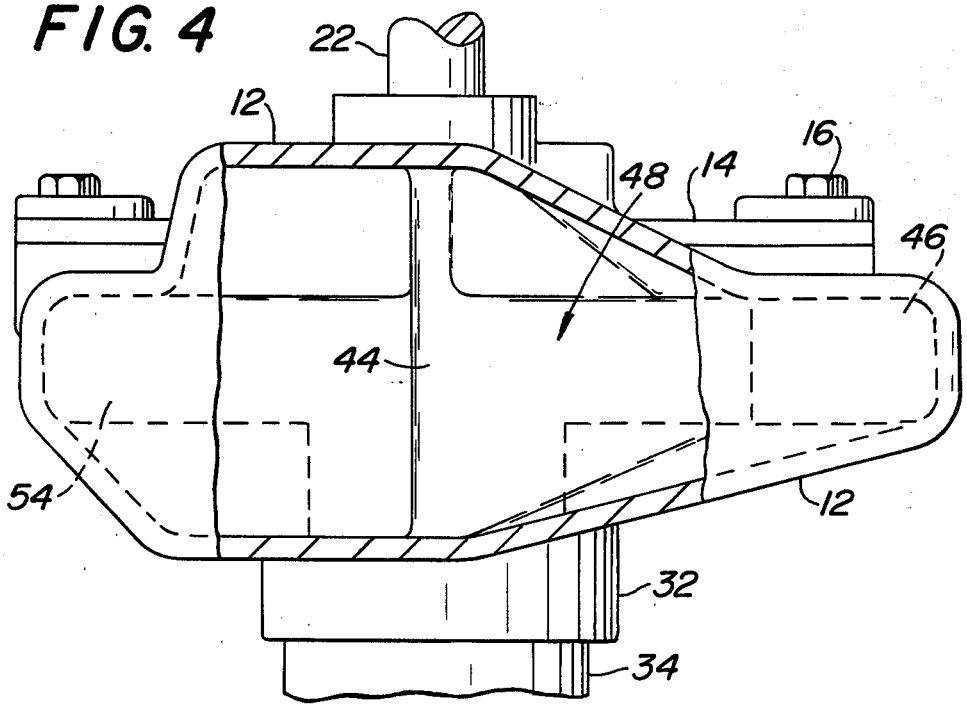
FIG. 4 is an end view as seen from the discharge end, with portions broken away for clarity of illustration.

Referring to the drawings in detail, wherein like numerals indicate like elements, there is shown in FIG. 1 a self-priming centrifugal pump in accordance with the present invention. The pump designated generally as 10 includes a casing 12 having a cover 14 removably attached thereto by a plurality of fasteners 16 on the motor drive side of the casing 12. As shown more clearly in FIG. 2, an electrical motor 18 has its housing removably attached to the cover 14 by fasteners 20. The motor 18 has a drive shaft 22 extending through a machined hole in the cover 14 for connection to the impeller 26. A seal 24 is provided between the cover 14 and shaft 22. Seal 24 is biased into position and retained therein by a spring 25. Spring 25 surrounds the shaft 22 and extends between the seal 24 and the impeller 26.

The casing 12 is provided with a pumping chamber 28. The impeller 26 is disposed within the chamber 28 and has a plurality of arcuate vanes 30 juxtaposed to a machined face of the casing 12 within the chamber 28. See FIG. 3.

Referring again to FIG. 2, casing 12 has a boss 32 coaxial with the impeller 26. An inlet conduit 34 is threadedly coupled to the boss 32. The inner periphery of the boss 32 defines an inlet chamber 36 which communicates with the chamber 28. The impeller 26 may have a rounded nose projecting into the inlet chamber 36 as shown in FIG. 2.

Figure 2:
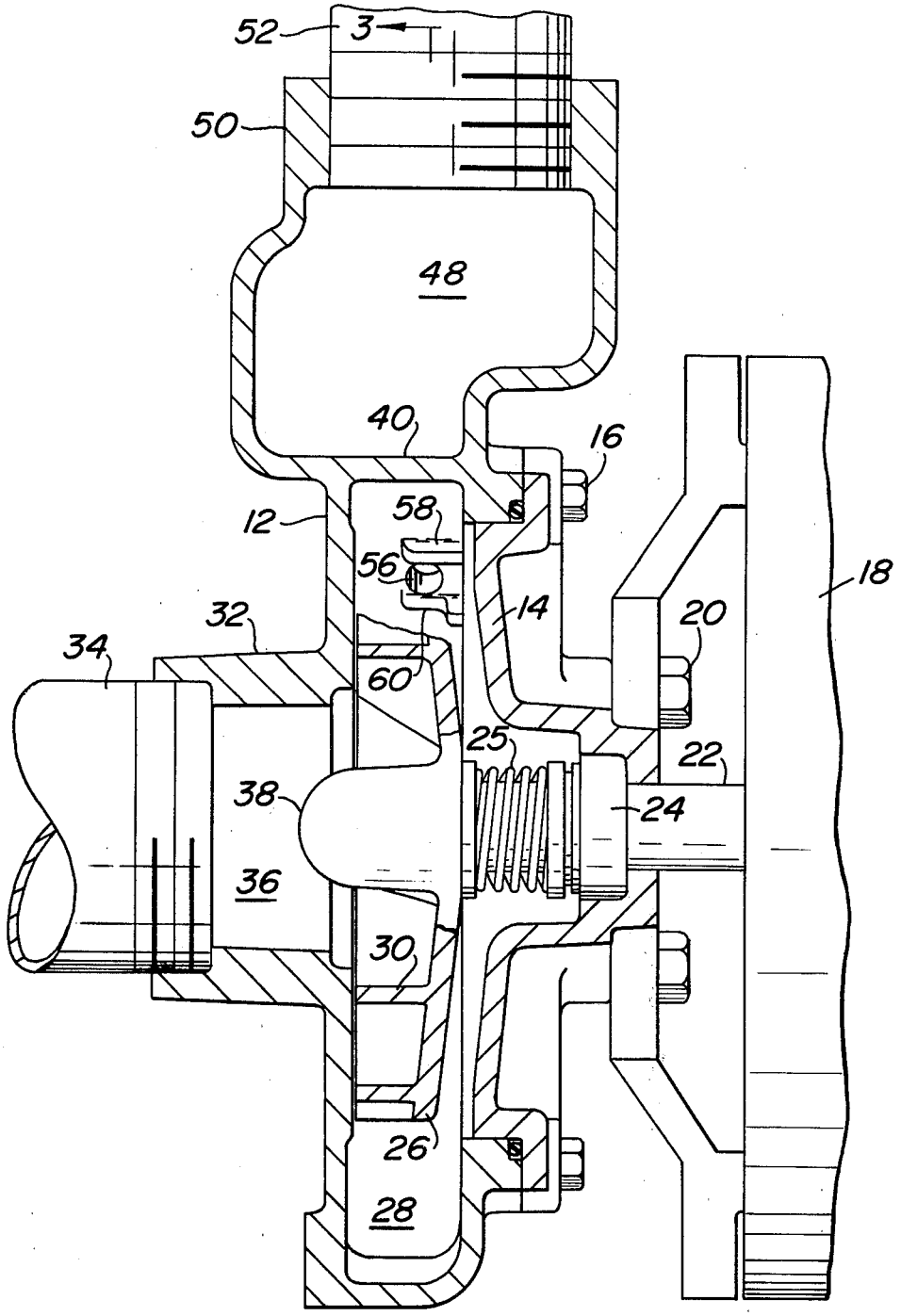
FIG. 2 is a sectional view taken along the line 2—2 in FIG. 1.
Figure 3:
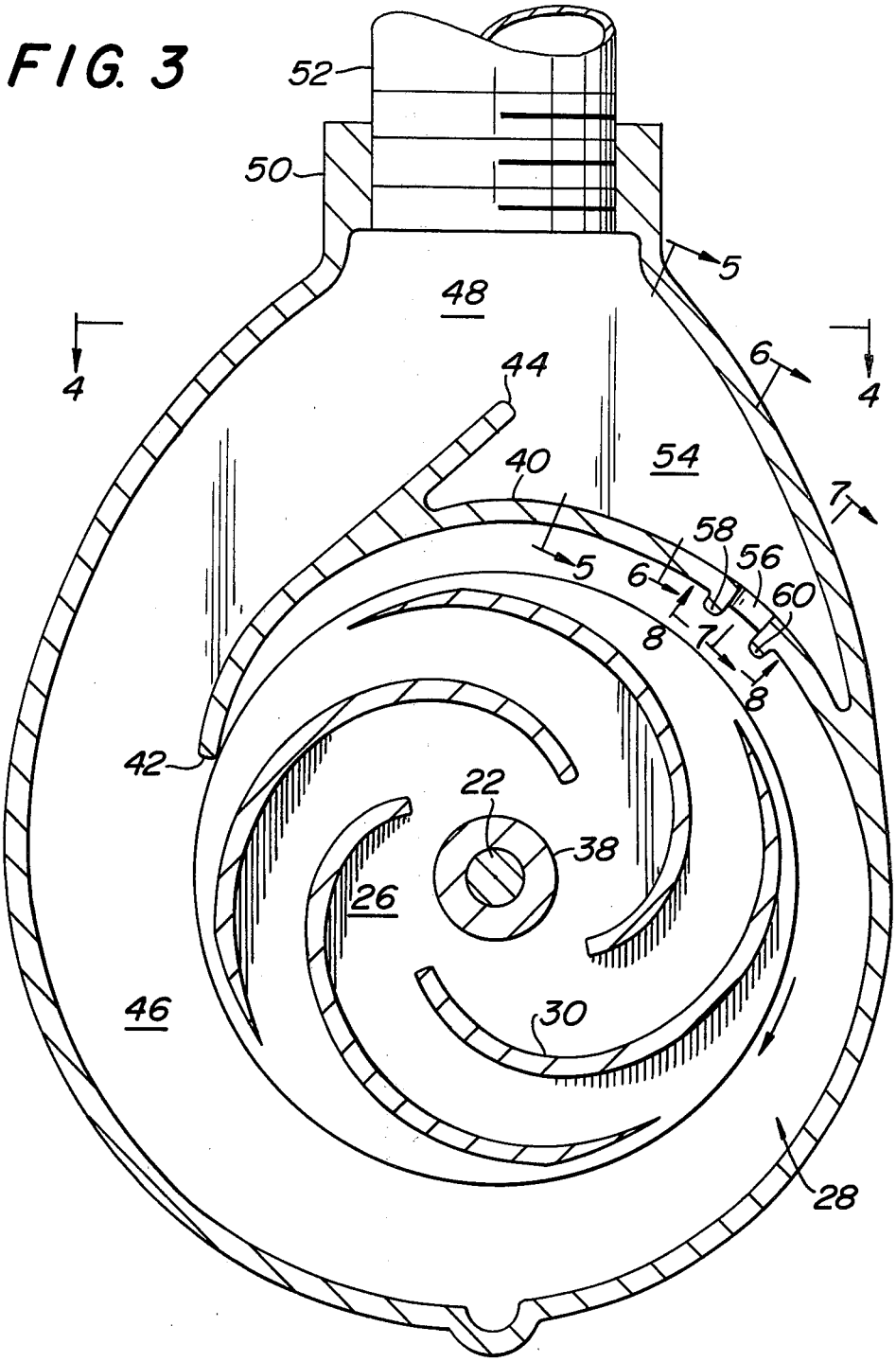
FIG. 3 is a sectional view taken along the line 3—3 in FIG. 2.

Referring to FIGS. 2 and 3, an arcuate wall 40 extends between opposite sides of the casing 12 and is integral therewith. Wall 40 has one end integral with the periphery of the casing 12 as shown more clearly in FIG. 3 with its other end 42 being a free end adjacent to the periphery of the impeller 26. The impeller 26 is circular and cooperates with the wall 40 as well as the inner periphery of the chamber 28 to define an involute flow passage 46 directed to the outlet chamber 48. Within the outlet chamber 48 the wall 40 has a tail 44. The outlet chamber 48 communicates with an outlet conduit 52. Conduit 52 is threaded to a boss 50 at the upper end of the casing 12.

A recirculation chamber 54 communicates directly with the outlet chamber 48. As shown more clearly in FIGS. 3, 5, 6 and 7, the recirculation chamber becomes progressively smaller at the end thereof remote from the outlet chamber 48. The recirculation chamber 54 communicates with the chamber 28 at a location where it is least likely to contain aerated liquid by way of a flow passage 56 extending through the wall 40. Passage 56 may be slightly angled with respect to a radius of the impeller 26 as illustrated.

A means is associated with the passage 56 to create a discontinuity of flow within passage 46 to thereby create a suction effect for sucking recirculation liquid from chamber 54 into chamber 28. Such means preferably is in the form of ribs 58 and 60 extending radially inwardly on opposite sides of the passage 56. See FIGS. 3 and 8. If desired, the rib 60 may have an extension 62 disposed radially along the side wall of the casing 12 to which the cover 14 is attached as shown in FIG. 7.

The transverse dimensions of the passage 56 are important. The passage 56 should be sufficiently large so that priming liquid will be supplied at a rate which prevents short circuiting of gas from discharge to suction. At the same time, the flow passage 56 should be small enough so as to deaerate the priming liquid flowing therethrough from chamber 54 to chamber 28. On a 1.5 inch centrifugal pump, I have found the preferred dimensions of flow passage 56 to be a hole having a diameter of about 5/16 inch. In connection with such a hole, the ribs 58, 60 were $\frac{1}{8}$ inch wide and projected radially inwardly at a location tangent to the hole for a distance of approximately $\frac{1}{8}$ inch.

In prototype embodiments of the pump of the present invention, a hole was cut through the wall of the casing 12 opposite the flow passage 56 and then sealed with a transparent plastic material which acted as a window. Self-priming was observed through the window with different sized flow passages 56. When the size of the flow passage 56 was smaller than the preferred dimension described above, priming liquid did not flow fast enough from chamber 54 to chamber 28 to prime the pump. When the size of the flow passage 56 was significantly greater than the preferred size set forth above, the priming liquid had too much air entrained therein whereby gas bubbles were observed flowing through the passage 56 and consequent difficult priming the pump. With flow passage 56 having the preferred dimension disclosed above, the flow passage 56 deaerates the air as a stream of upwardly moving bubbles was observed with good priming being obtained under the combined effects of gravity and suction. The suction was created by the discontinuity of flow within the chamber 28 at the passage 56.

A comparison of the above-mentioned pump with prior art pumps of comparable size resulted in the pump of the present invention being primed with only 15 ounces of water as compared with prior art pumps requiring 40 to 45 ounces of water with all other factors being held constant. Since the amount of priming liquid needed is less, the entire pump may be made smaller.

Thus, by proper sizing of the flow passage 56 and by adding ribs 58, 60, I have found that a centrifugal pump can be primed with only one-third the normal amount of priming liquid. This result is unexpected. It is further unexpected that the result could be attained in such a simple and inexpensive manner which does not involve radical design changes, and does not require any specialized tooling. The ribs 58, 60 create the discontinuity of flow so as to create high local velocities having a suction effect on the recirculated priming liquid.

The present invention may be embodied in other specific forms without departing from the spirit or essential attributes thereof and, accordingly, reference should be made to the appended claims, rather than to the foregoing specification, as indicating the scope of the invention.

I claim:

1. A self-priming centrifugal pump comprising a casing having a pumping chamber, said casing having an inlet and an outlet communicating with said pumping chamber, said outlet being above the pumping chamber, a motor driven impeller in said pumping chamber for pumping a liquid from said inlet to said outlet, said casing having a priming chamber, said priming chamber being above the pumping chamber and communicating at one end with said outlet, a wall of said housing which separates said pumping chamber and priming chamber having a flow passage for recirculating a priming liquid from said priming chamber to the upper end portion of said pumping chamber at a location radially outwardly from said impeller, means for creating a discontinuity of flow in the pumping chamber at said passage so that priming liquid can be recirculated under the combined forces of gravity and suction acting to self-prime the pump, and said passage being sufficiently large so that it deaerates the priming liquid while supplying sufficient priming liquid to prevent a short circuit of gas from the outlet to the inlet during the priming of the pump.

2. A pump in accordance with claim 1 wherein said means for creating a discontinuity of flow includes a pair of ribs extending generally radially inwardly from said wall on opposite sides of said passage.

3. A pump in accordance with claim 2 wherein said passage is a hole having a diameter about 5/16 inch.

4. A pump in accordance with claim 1 wherein, said priming chamber converging downwardly in a direction from said one end toward said passage.

5. A pump in accordance with claim 1 wherein said means includes a rib adjacent said passage, said rib being L-shaped with one leg integral with a wall of the casing and generally radially disposed with respect to the impeller while the other leg is generally parallel to the axis of rotation of the impeller.

6. A pump in accordance with claim 1 wherein said casing has an outlet chamber communicating with said outlet, said priming chamber communicating at its upper end with said outlet chamber, said wall being arcuate and having a tail tangent thereto and extending therefrom, said tail partially separating said outlet chamber from said priming chamber.

7. A self-priming centrifugal pump comprising a casing having a pumping chamber, said casing having an inlet and an outlet, said inlet communicating with said outlet by way of an involute flow passage in said pumping chamber, said outlet being above the pumping chamber, a motor driven impeller in said pumping chamber for pumping liquid from said inlet to said outlet via said flow passage, a wall of said housing separating the pumping chamber from a priming chamber thereabove, said wall having an opening for recirculating a priming liquid directly from the lower end of the priming chamber to the upper end of said pumping chamber, said casing having an outlet chamber communicating with said outlet, said priming chamber communicating at its upper end with said outlet chamber, said wall being arcuate and having a tail tangent thereto and extending upwardly therefrom, said tail partially separating said outlet chamber from said priming chamber, said priming chamber converging downwardly in a direction from its upper end toward said passage, and means for creating a discontinuity of flow in the pumping chamber at said opening so that liquid can be recirculated from the priming chamber to the pumping chamber under the combined forces of gravity and suction to self-prime the pump, said opening being sufficiently large so that it deaerates the priming liquid while supplying sufficient liquid to prevent a short circuit of gas from the outlet to the inlet during the priming of the pump.

* * * * *